United States Patent [19]

Jung-Sun

[11] Patent Number: 4,498,787

[45] Date of Patent: Feb. 12, 1985

[54] REMINDER

[76] Inventor: Lin Jung-Sun, No. 150-2, Hsi Ta Wang, Hsi Wang Tsun, Yung Kang Hsiang, Tai, Taiwan

[21] Appl. No.: 636,174

[22] Filed: Jul. 31, 1984

[51] Int. Cl.[3] ..... G04B 47/00; G04B 21/08

[52] U.S. Cl. ..... 368/10; 368/63; 368/73

[58] Field of Search ..... 368/10, 12, 41, 63, 368/72–74, 250, 251; 360/69, 70; 369/19–23

[56] References Cited

U.S. PATENT DOCUMENTS 3,644,682 2/1972 Parilla ..... 369/23
3,835,640 9/1974 Hughes, Jr. ..... 368/63
3,919,834 11/1975 Murakami et al. ..... 368/63
4,389,121 6/1983 Hashimoto et al. ..... 368/63

*Primary Examiner*—Vit W. Miska
*Attorney, Agent, or Firm*—Ladas & Parry

[57] ABSTRACT

A power supplied reminder electrically connects a tape recorder capable of recording therein a tape recording, a clock capable of time setting, an alarming unit having an alarming circuit and a buzzing speaker and two interlinking switches respectively connected to the alarming circuit and the tape recorder so that the speaker will buzz when a time set in the clock arrives and when the switch connected to the alarming circuit is switched off and the other switch connected to the tape recorder is switched on and thus the tape recorder will play to reproduce the tape recording in which something to done is recorded to remind one to do the something.

7 Claims, 5 Drawing Figures

REMINDER

BACKGROUND OF THE INVENTION

The present invention relates to a reminder, and more particularly to a reminder the reminding function of which is not performed by a living being.

Applicant feels that it is rather convenient or necessary for a busy or forgetful person to employ an apparatus which is capable of reminding a person of important events, and thus such an apparatus is attempted.

SUMMARY OF THE INVENTION

It is therefore an object of the present invention to provide an apparatus to act as a reminder to inform one to do something at the time on which the something should be done.

According to the present invention, a reminder includes a tape recorder capable of recording therein a tape recording of which something to be done at some time is stored, a clock electrically connected to the tape recorder, capable of time setting and adapted to be electrically connected to a power supply, an alarming unit having an alarming circuit and a buzzing speaker and electrically connected to the clock so that the speaker can buzz when the time at which the clock is set arrives and two interlinking switches one of which is electrically connected to the alarming circuit which is energized and de-energized by the power supply respectively when the one switch is switched on and off respectively and the other of which is kept switched off and on respectively when the one switch is switched on and off respectively and electrically connected to the tape recorder which can be energized and de-energized respectively when the the other switch is kept switched on and off respectively so that the speaker will buzz when the time set in the clock arrives and when the one switch is switched off the the other switch is switched on and thus the tape recorder will play to reproduce the tape recording to remind one to do the something.

Preferably the buzzing speaker is capable of volume and tone adjusting.

Preferably the reminder further includes a transfer switch to which the clock, the tape recorder and the power supply are electrically connected and when switched in a first position the clock and the tape recorder are elelctrically connected to each other and when switched in a second position the clock and the tape recorder are in an electrical interruption.

Certainly, the tape of the tape recorder can be a loop tape and the tape recorder further electrically connects to a first delay circuit which enables the tape recorder to erase the tape recording at a later time after the tape recording has been played.

The clock can be an electronic clock having a light emitting diodes (LEDs) set for time indication and an integrated circuit (IC) for clock use being electrically connected to the tape recorder.

Preferably the tape recorder further electrically connects a second delay circuit which enables the tape recorder to repetitiously reproduce the tape recording at a later time after the the other switch has been switched on.

Preferably the power supply is an automatic AC/DC switching power supply.

The present invention may best be understood with reference to the accompanying drawings, in which:

DETAILED DESCRIPTION OF THE PREFERRED EMBODIMENT

Figure 1:
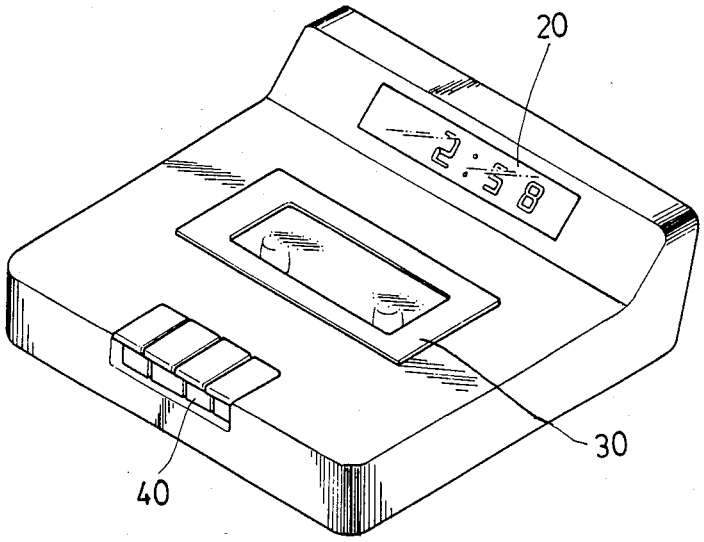
FIG. 1 is a perspective view of the outer appearance of a reminder according to the present invention.

As shown in FIG. 1, the outer appearance of a reminder of the present invention shows a time indication screen 20, a tape receiving portion 30 and a plurality of push buttons 40.

Figure 2:
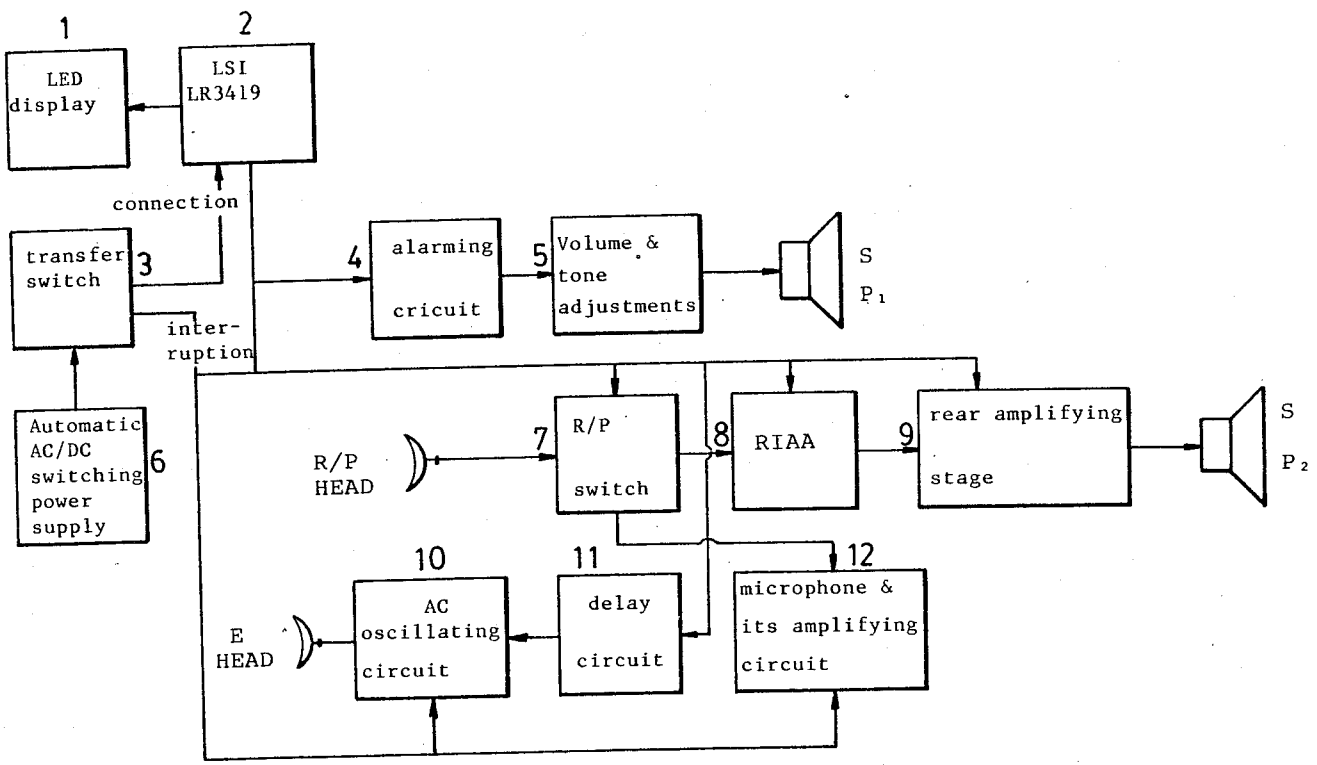
FIG. 2 is a circuit block diagram of a reminder of the present invention.

Referring now to FIG. 2, a reminder of the present invention includes a tape recorder which is capable of recording therein a tape recording of which something to be done at some time is reserved and includes a R/P head, a R/P head switch 7, a RIAA 8, a rear amplifying stage 9, a speaker SP2, an AC oscillating circuit 10, an E head, a first delay circuit 11 enabling the tape recorder to erase the tape recording at a later time after the tape recording has been played and a microphone together with its amplifying circuit 12, an electronic clock which is electrically connected to the tape recorder and capable of time setting and includes a light emitting diodes (LEDs) set 1 for time indication and an integrated circuit (IC) 2 for clock use, e.g. a LSI LR3419 IC, an alarming unit which has an alarming circuit 4, volume and tone adjustments 5 and a buzzing speaker SP1 and is electrically connected to the electronic clock so that the speaker can buzz when the some time which is set in the electronic clock is due and a transfer switch 3 to which the electronic clock, the tape recorder and an automatic AC/DC switching power supply 6 are electrically connected and when switched in a first position the electronic clock and the tape recorder are electrically connected to each other and when switched in a second position the electronic clock and the tape recorder are in an electrical interruption.

Figure 5:
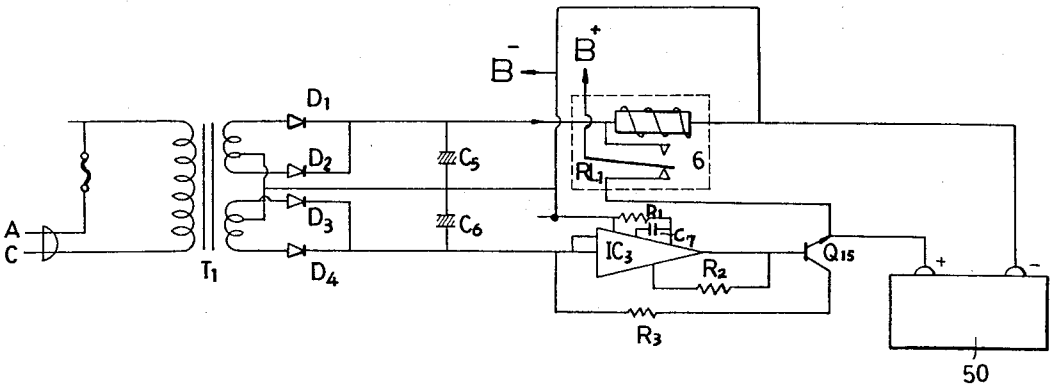
FIG. 5 is a circuit diagram of a power supply of a reminder of the present invention.

Referring now to FIG. 5, an automatic AC/DC power supply can be used in the present reminder generally includes a transformer T1, an integrated circuit IC3, a power transistor Q15, a relay RL1 and a battery 50. Supplied power 110 V or 220 V through transformer T1 is formed into two sets of voltages, i.e. a 12 V rectified by diodes D1 & D2 and filtered by a capacitor C5 for the electronic clock's use and a 16 V rectified by diodes D3 & D4, filtered by a capacitor C6 and transmitted to IC3, R1, R2, R3, C3 & Q15 for voltage stabilization and current amplification for obtaining a standardized 13.2 V to protect battery 20. As long as the supplied power source is on and thus relay RL1 is on, the 12 V acts as the power supply of the present reminder which is energized by battery 20 when the supplied power source is off and thus relay RL1 is off.

Figure 3:
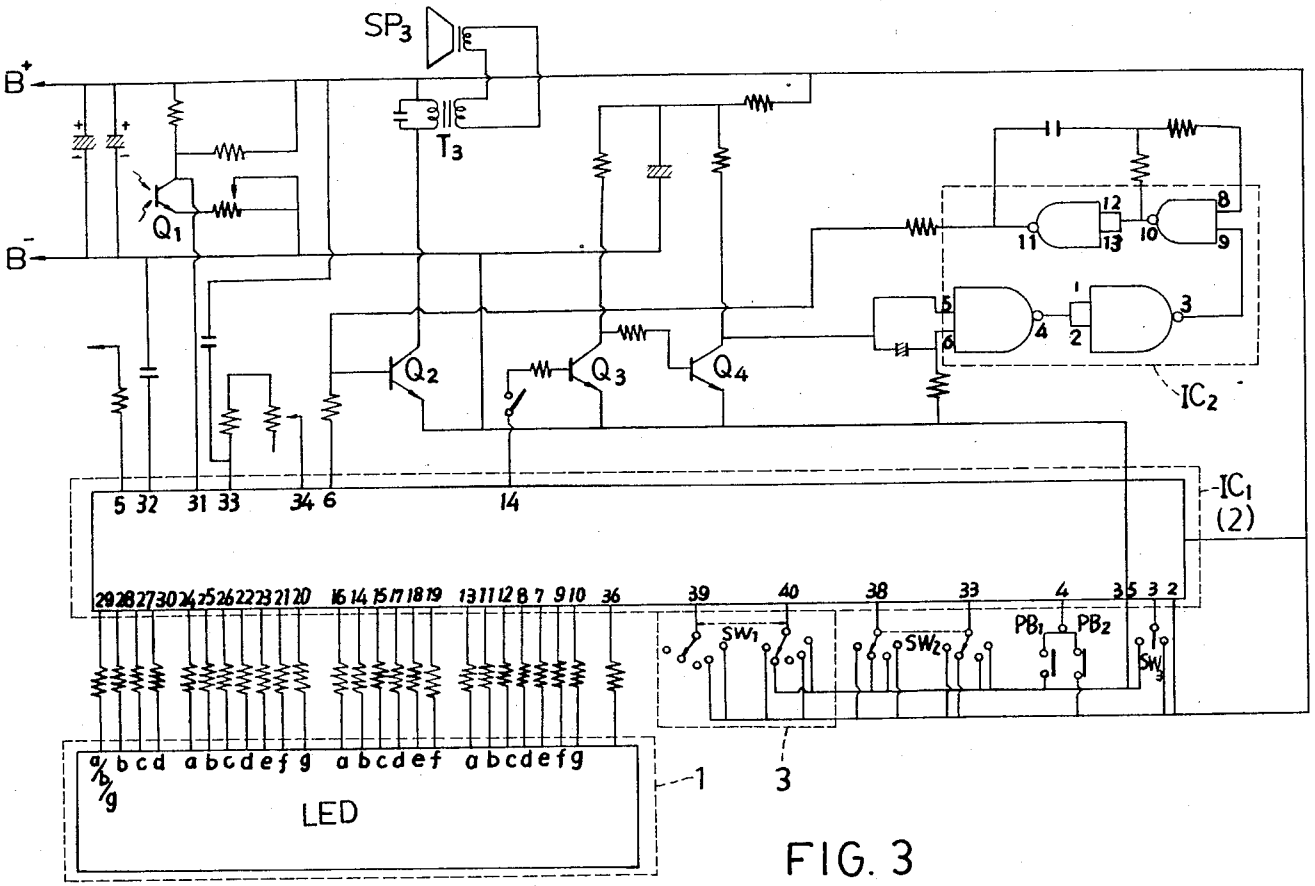
FIG. 3 is a circuit diagram of a clock of a reminder of the present invention.

The electronic clock broadly includes, as shown in FIG. 3 as LEDs set 1, the IC1, IC2 and transistors Q2, Q3 & Q4. The clock pulse is provided by 50 HZ or 60 HZ of the AC power source frequency and is provided by an oscillating circuit powered by battery 20 should the AC power source be off on which and in the meantime LEDs set 1 will not do the work of time indication.

Each o'clock on the dot, the pin 14 of IC1 outputs a voltage which is amplified by transistors Q3, Q4 to enable the pins 5, 6 of IC2 high, the pin 4 of IC2 low and the pin of IC2 high and thus the oscillating circuit constituted by the pins 8, 11 of IC2 will oscillate and have it oscillating signal amplified by transistor Q2 and through an output transformer T3 to drive a speaker SP3. In a good light environment, the transistor Q1 gets a current flow and thus a voltage drop and the LEDs set 1 will automatically reduce its light intensity and when the environment is in a poor light there is no current flowing in Q1 and thus LEDs set 1 automatic recovers to its maximum light intensity.

Figure 4:
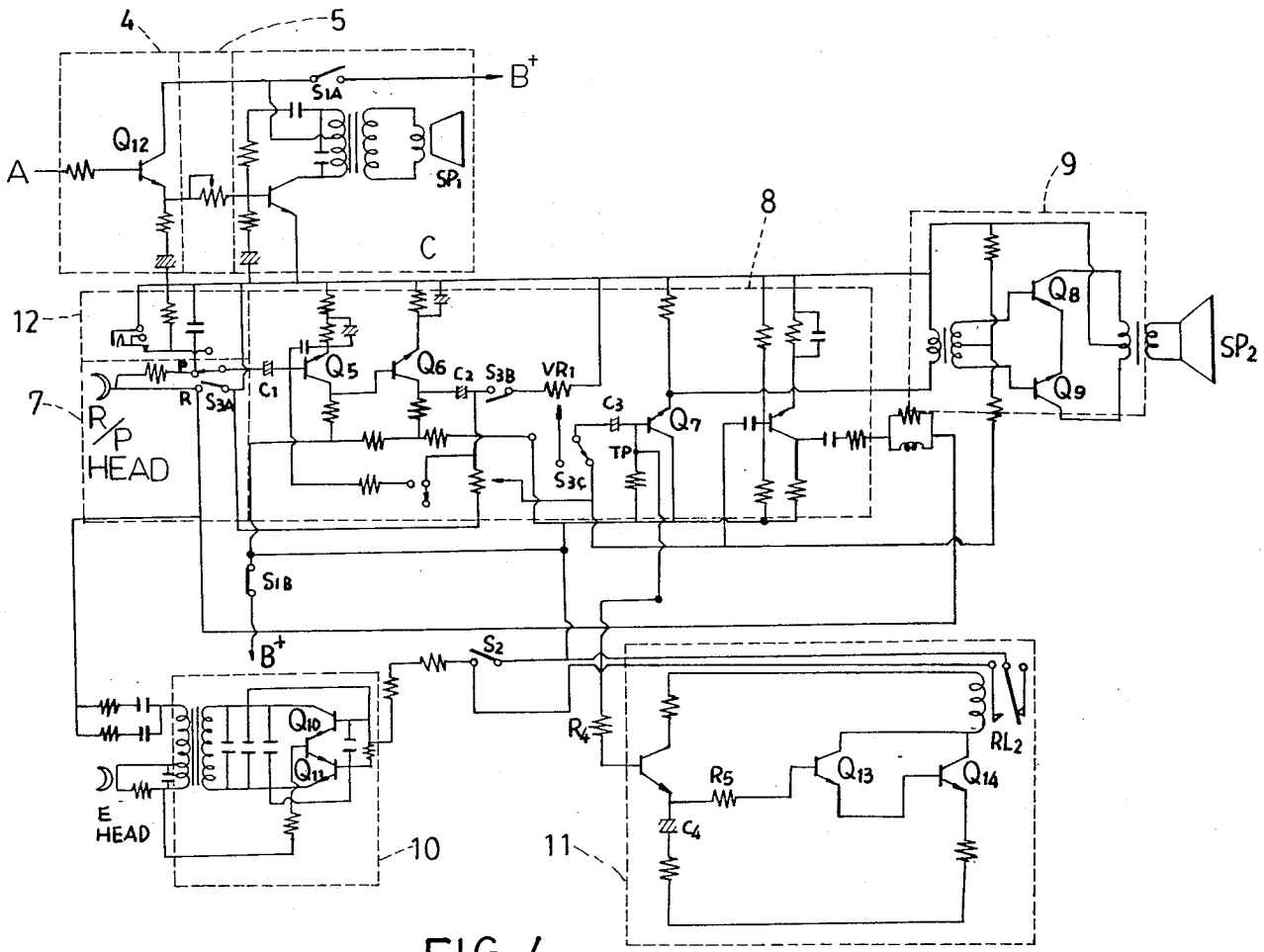
FIG. 4 is a circuit diagram of a tape recorder of a reminder of the present invention.

As shown in FIG. 4, there is shown a circuit diagram of a tape recorder and an alarming unit having an alarming circuit to the base of transistor Q12 of which when the time set in the electronic clock arrives the pin 5 of IC1 outputs and the voltage is amplified to energize its buzzer C, volume and tone adjustments 5 and a speaker SP1. The R/P switch is depicted by S3A which when switched to point R inputting signal comes from microphone 12 and when switched to point P, through a parallel capacitor C1, the signal transmitted to transistors Q5, Q6 to be amplified and thereafter transmitted to the coupling capacitor C2, switch S3B, volume adjustment VR1, P/R switch S3C, capacitor C3 and to driving amplifying stage Q7 to reach power amplifying stage Q8, Q9 drives the speaker SP2. At the meanwhile, through the resistor R4, the voltage at point TP charges the capacitor C4 which when saturated discharges to the resistor R5 to trigger transistors Q13, Q14 and thus actuate the relay RL2 on which time the B+ voltage supplies to the oscillating circuit Q10, Q11 from which the oscillating AC signal transmits to the E head to erase the memory of the tape recording; but if one desires to store the tape recording, then switch S2 should be switched off.

Two interlinking switches S1A, S1B are electrically connected to the alarming unit and the tape recorder respectively. When the time set in the electronic clock arrives speaker SP1 will buzz and when switch S1A is switched off switch S1B is switched on and thus the tape recorder will play to reproduce the tape recording to remind one to do something.

Certainly, if a time interval is called for between the time switch S1A is switched off and the time the tape recorder reproduces the tape recording, a second delay circuit can be electrically connected to the tape recorder.

While the present invention has beed described in connection with what is presently considered to be the most practical and preferred embodiment, it is to be understood that the invention is not to be limited to the disclosed embodiments but on the contrary, is intended to cover various modifications and equiuvalent arrangements included within the spirit and scope of the appended claims which scope is to be accorded the broadest interpretation so as to encompass all such modifications and equivalent structures.

What I claim is:

1. A reminder comprising:

a tape recoder capable of recording therein a tape recording of which something to be done at some time is reserved;

a clock electrically connected to said tape recoder, capable of time setting and adapted to be electrically connected to a power supply;

an alarming unit having an alarming circuit and a buzzing speaker and electrically connected to said clock so that said speaker can buzz when said time at which it is set in said clock arrives; and two interlinking switches one of which is electrically connected to said alarming circuit which is energized and de-energized by said power supply respectively when said one switch is switched on and off respectively, and the other of which is kept switched off and on respectively when said one switch is switched on and off respectively, and electrically connected to said tape recorder which can be energized and de-energized respectively, when said the other switch is kept switched on and off respectively whereby said speaker will buzz when said time set in said clock arrives and when said one switch is switched off and said the other switch is switched on and thus said tape recorder will play to reproduce said tape recording to remind one to do said something.

2. A reminder according to claim 1 wherein said buzzing speaker is capable of volume and tone adjusting.

3. A reminder according to claim 2, further comprising a transfer switch to which said clock, said tape recorder and said power supply are electrically connected and when switched in a first position said clock and said tape recorder are electrically connected to each other and when switched in a second position said clock and said tape recorder are in an electrical interruption.

4. A reminder according to claim 3 wherein the tape of said tape recorder is a loop tape and said tape recorder further electrically connects a first delay circuit which enables said tape recorder to erase said tape recording at a later time after said tape recording has been played.

5. A reminder according to claim 4 wherein said clock is an electronic clock having light emitting diodes (LEDs) set for time indication and an integrated circuit (IC) for clock use being electrically connected to said tape recorder.

6. A reminder according to claim 5 wherein said tape recorder further electrically connects to a second delay circuit which enables said tape recorder to repetitiously reproduce said tape recording at a later time after said the other switch has been switched on.

7. A reminder according to claim 6 wherein said power supply is an automatic AC/DC switching power supply.

* * * * *